United States Patent [19]

Schock

[11] Patent Number: 4,993,591

[45] Date of Patent: Feb. 19, 1991

[54] AUTOMATIC VENDING MACHINE

[75] Inventor: Hans Schock, Mintraching, Fed. Rep. of Germany

[73] Assignee: Händler GmbH und Co KG Metall- und Maschinenbau, Neutraubling, Fed. Rep. of Germany

[21] Appl. No.: 443,574

[22] Filed: Nov. 29, 1989

Related U.S. Application Data

[63] Continuation of PCT Application PCT/DE88/00330 filed June 3, 1988.

[30] Foreign Application Priority Data

Jun. 6, 1987 [DE] Fed. Rep. of Germany ..... 3719095

[51] Int. Cl.[5] ..... G07F 11/48; G07F 11/62

[52] U.S. Cl. ..... 221/91; 221/197

[58] Field of Search ..... 221/89, 91, 197

[56] References Cited

U.S. PATENT DOCUMENTS

| | | | |
|---|---|---|---|
| 761,351 | 5/1904 | Beier | 221/91 |
| 2,540,856 | 2/1951 | Andrews et al. | 221/197 X |
| 3,486,658 | 12/1969 | Cheslak et al. | 221/197 |
| 4,296,980 | 10/1981 | Takaniemi | 221/91 X |

FOREIGN PATENT DOCUMENTS

| | | |
|---|---|---|
| 103965 | 2/1898 | Fed. Rep. of Germany . |
| 3719095 | 4/1989 | Fed. Rep. of Germany . |
| 2103702 | 4/1972 | France . |
| 2117113 | 7/1972 | France . |
| 461864 | 10/1968 | Switzerland . |
| 1140341 | 1/1969 | United Kingdom . |

*Primary Examiner*—F. J. Bartuska

*Attorney, Agent, or Firm*—Herbert L. Lerner; Laurence A. Greenberg

[57] ABSTRACT

An automatic vending machine includes a drop and delivery shaft defining a drop direction therein for product packages such as bottles or cans. A fixation frame communicates with the drop and delivery shaft for receiving a box having compartments defining product positions for product packages and having an open top being inclined relative to the drop direction for discharging into the drop and delivery shaft. A belt is attached to the fixation frame and covers the open top of the box. The belt has an opening formed therein with a contour dimensioned to permit precisely one predetermined group of adjacent product packages in the box, preferable containing only one single product package, to pass through the opening. The opening is displaceable from one product position in the box to another by incrementally moving the belt.

7 Claims, 2 Drawing Sheets

AUTOMATIC VENDING MACHINE

CROSS REFERENCE TO RELATED APPLICATION

Figure 1:
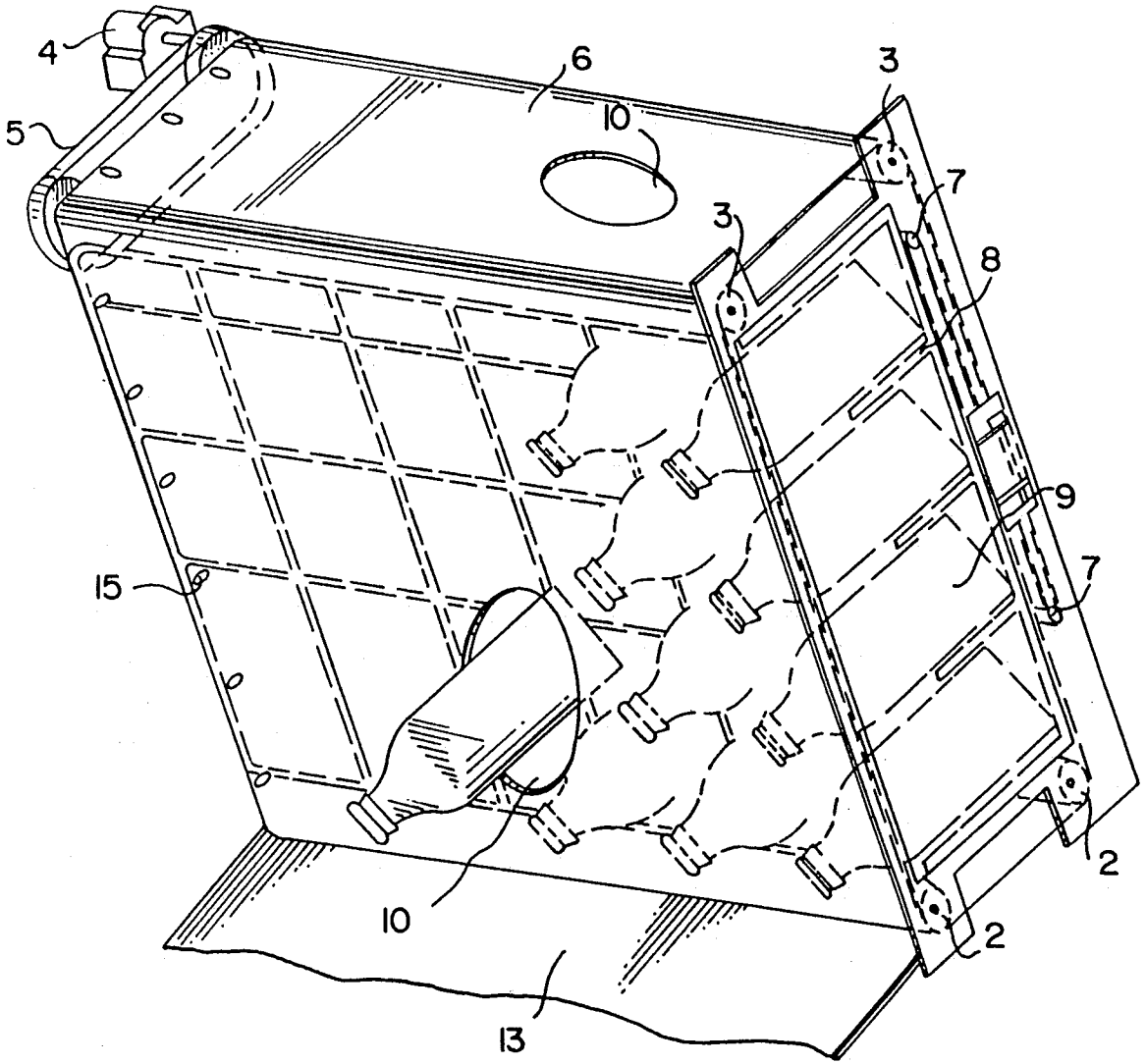

This is a continuation of PCT application PCT/DE 88/00330 filed Jun. 3, 1988.

The invention relates to an automatic vending machine having a drop and delivery shaft for product packages, in particular bottles or cans.

Such automatic vending machines are filled with product packages by removing the packages from a shipping container, for instance a box or case, and lining them up in a delivery chute or delivery slide of the automatic vending machine. The removal of the product packages from the shipping container and alignment in the automatic vending machine is quite time consuming.

It is accordingly an object of the invention to provide an automatic vending machine, which overcomes the hereinaforementioned disadvantages of the heretofore-known devices of this general type and in which the operation of removing the product packages from the shipping container and lining them up in the automatic vending machine, is avoided.

With the foregoing and other objects in view there is provided, in accordance with the invention, an automatic vending machine, comprising a drop and delivery shaft defining a drop direction therein for product packages, such as bottles or cans; a fixation frame communicating with the drop and delivery shaft for receiving a box having compartments defining product positions for product packages and having an open top being inclined relative to the drop direction for discharging into the drop and delivery shaft; a belt being attached to the fixation frame and covering the open top of the box, the belt having an opening formed therein with a contour dimensioned to permit precisely one predetermined group of adjacent product packages in the box, preferably containing only one product package, to pass through the opening; and means for displacing the opening from one product position in the box to another by incrementally moving the belt.

In this automatic vending machine, the box, which is open on the top or on one side, can advantageously become the shipping container for the product packages in which these packages are transported to the automatic vending machine. This box serving as the shipping container is simply inserted into the automatic vending machine, without removing the packages; the control mechanism of the automatic vending machine moves the belt at the rate at which appropriate coins are inserted into the automatic vending machine, and when moving the belt displaces the opening in the belt from one product group position in the box to another. The groups of products located at the various product group positions in the box also drop at this rate successively through the opening in the belt into the drop and delivery shaft of the automatic vending machine, and they can finally be removed from the delivery end.

In accordance with another feature of the invention, the belt is endless. This feature, along with the fact that the belt is attached to the fixation frame, makes the manufacture of the automatic vending machine simpler and more economical.

In accordance with a further feature of the invention, the fixation frame and the open top of the box are outwardly pivotable together out of the drop direction in the drop and delivery shaft.

In accordance with an added feature of the invention, the compartments in the box are disposed in rows and columns at right angles to one another.

In accordance with an additional feature of the invention, the compartments in the box are disposed in rows and columns at right angles to one another, the opening formed in the belt is a first opening associated with a first column of compartments in the box, the belt has a second opening formed therein being associated with a second column of compartments in the box, and the second opening is adjacent to and spaced apart from the first opening, as seen in the direction of motion of the belt, by a distance causing the first opening to first pass successively over the compartments of the first column in the box and then the second opening to pass successively over the compartments of the second column in the box, upon the motion of the belt.

In accordance with a concomitant feature of the invention, the box is a shipping container for shipping the product packages to the automatic vending machine.

These features facilitate the insertion of the box having the product packages in the automatic vending machine.

Other features which are considered as characteristic for the invention are set forth in the appended claims.

Although the invention is illustrated and described herein as embodied in an automatic vending machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
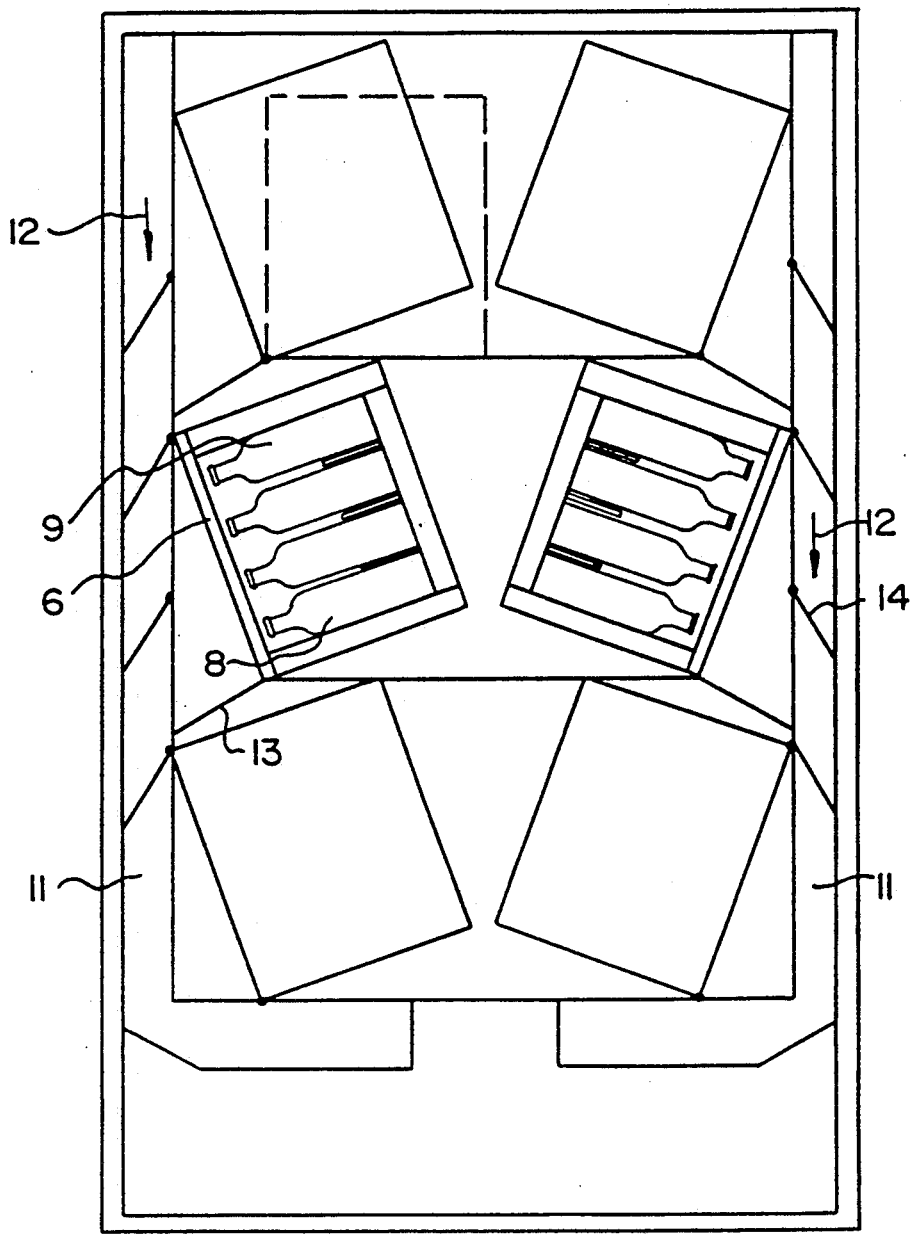

FIG. 1 is a fragmentary, diagrammatic, perspective view of a fixation frame in an automatic vending machine for a box that is used to transport 20 beer bottles; and FIG. 2 is a highly diagrammatic front-elevational view of an automatic vending machine having six fixation frames according to FIG. 1.

Referring now to the figures of the drawing in detail and first, particularly, to FIG. 1 thereof, there is seen a fixation frame which is of cuboid shape and has one elongated roller 2 or 3 each on four edges of the cuboid. The rollers are parallel to one another and the longitudinal axes of the rollers are also parallel to one another and to the edges of the cuboid. All four rollers 2, 3 are rotatably supported about the longitudinal axes thereof. The two rollers 3, which are located on the same side of the cuboid, are drivable by an electric drive motor 4 through a V-belt, so as to rotate about the longitudinal axes thereof.

An endless plastic belt or band 6, which has the support surface thereof parallel to the longitudinal axes of the rollers 2 and 3, wraps around the fixation frame and rests on the outer or jacket surfaces of the rollers 2 and 3. The endless plastic belt 6 can be tensioned with auxiliary rollers 7, which have longitudinal axes that are parallel to the longitudinal axes of the rollers 2 and 3 and are both also encompassed by the endless plastic belt 6. The spacing between the auxiliary rollers 7 is adjustable.

A box or case 8 is insertable into the fixation frame of FIG. 1 from one side of the frame, at right angles to the longitudinal axes of the rollers 2 and 3. The box 8 is used to ship packaged goods in the form of 20 beer bottles 9 and has compartments on the bottom in which these beer bottles 9 are positioned in the box 8. These compartments for the beer bottles 9 are disposed in rows and columns that are perpendicular to one another in the box 8.

In the fixation frame of FIG. 1, the open top of the box 8 is covered only by the plastic belt 6, which has five openings 10. The openings 10 are circular and are adapted to the cross section and therefore to the contour of the beer bottles 9, so that the contour of the openings are dimensioned to permit precisely one predetermined group of adjacent product packages in the box, preferable containing only one single product package or beer bottle 9, to pass through the openings 10 in the longitudinal direction of the bottle.

Each of the five openings 10 in the plastic belt 6 is associated with a different column of compartments of the box 8. As viewed in the direction of motion of the plastic belt 6, each of the five openings 10 are also spaced apart from the adjacent opening 10 in the plastic belt 6 by such a distance, that during the incremental motion of the belt about the edges of the fixation frame having the rollers 2 and 3, which is controlled by sprocket holes 15 in the plastic belt 6, a first opening first passes successively over the compartments in a first column of the box 8, then a second opening 10 successively passes over the compartments in a second column of the box 8, and so forth, until finally a fifth opening 10 passes in succession over the compartments in a fifth column of the box 8, so that all 20 compartments in the box 8 have been successively passed over by the five openings 10. Since one opening 10 was located in front of only a single compartment of the box 8 after each increment in the motion of the plastic belt 6, and since the fixation frame having the box 8 is also inclined in such a way that the open top of the box 8 discharges into a drop and delivery shaft or dispensing chute of the automatic vending machine and is also inclined into the drop or fall direction in this drop and delivery shaft, only a single beer bottle 9 to be removed at the delivery end has dropped at a time through a corresponding opening 10 in the plastic belt 6 into the drop and delivery shaft of the automatic vending machine after each motion increment of the plastic belt.

In the illustration of the automatic vending machine of FIG. 2, each of six fixation frames is disposed in such a way that the open top of the box 8 thereof discharges into a drop and delivery shaft or dispensing chute 11 and is inclined into the drop or fall direction, which is symbolized by the arrows 12. Baffles 13 for the dropping bottles 9 which are also provided, lead to the drop and delivery shaft 11. Elastically resilient, automatic-return braking flaps 14 for the bottles 9 are also provided in the drop direction in the delivery shaft 11.

The fixation frames can also be pivoted about a pivot axis, which is at right angles to the plane of the drawing in FIG. 2 and parallel to the longitudinal axes of the rollers 2 and 3, into a position which is represented by dashed lines in FIG. 2, and in which the open top of the box 8 is parallel to the drop direction corresponding to the arrows 12. In this position, boxes 8 filled full of bottles 9 can be thrust-in a favorably manner, particularly into the fixation frames from the front, in a direction at right angles to the plane of the drawing of FIG. 2.

The foregoing is a description corresponding in substance to German Application No. P 37 19 095.4, dated Jun. 6, 1987 and PCT/DE 88/00330, dated Jun. 3, 1988, the International priority of which is being claimed for the instant application, and which are hereby made part of this application. Any material discrepancies between the foregoing specification and the aforementioned corresponding applications are to be resolved in favor of the latter.

I claim:

1. Automatic vending machine, comprising:

(a) a drop and delivery shaft defining a drop direction therein for product packages;

(b) a fixation frame communicating with said drop and delivery shaft for receiving a box having compartments defining product positions for product packages and having an open top being inclined relative to said drop direction for discharging into said drop and delivery shaft;

(c) a belt being attached to said fixation frame and covering said open top of the box, said belt having an opening formed therein with a contour dimensioned to permit precisely one predetermined group of adjacent product packages in the box to pass through said opening;

(d) said fixation frame, sand belt and the open top of the box being outwardly pivotable together out of said drop direction in said drop and delivery shaft; and (e) means for displacing said opening from one product position in the box to another by incrementally moving said belt.

2. Automatic vending machine according to claim 1, wherein the product packages are bottles or cans.

3. Automatic vending machine according to claim 1, wherein the group of adjacent product packages has a single product package.

4. Automatic vending machine according to claim 1, wherein said belt is endless.

5. Automatic vending machine according to claim 1, wherein the compartments in the box are disposed in rows and columns at right angles to one another.

6. Automatic vending machine according to claim 1, wherein the compartments in the box are disposed in rows and columns at right angles to one another, said opening formed in said belt is a first opening associated with a first column of compartments in the box, said belt has a second opening formed therein being associated with a second column of compartments in the box, and said second opening is adjacent to and spaced apart from said first opening, as seen in the direction of motion of said belt, by a distance causing said first opening to first pass successively over the compartments of the first column in the box and then the second opening to pass successively over the compartments of the second column in the box, upon the motion of said belt.

7. Automatic vending machine according to claim 1, wherein the box is a shipping container for shipping the product packages to the automatic vending machine.

* * * * *